US006131312A

United States Patent [19]

Hung

[11] Patent Number: 6,131,312

[45] Date of Patent: Oct. 17, 2000

[54] SAFETY SHOE WITH DETACHABLE STEEL TOE BOX

[76] Inventor: Cheng-Che Hung, No. 255, Pi-Chung Street, Yen-Cheng Dist., Kahsiung City, Taiwan

[21] Appl. No.: 09/352,366

[22] Filed: Jul. 13, 1999

[51] Int. Cl.[7] ..... A43C 13/14

[52] U.S. Cl. ..... 36/77 R; 36/72 R; 36/96; 36/5

[58] Field of Search ..... 36/77 R, 77 M, 36/72 R, 96, 113, 132, 136, 100, 15, 11.5

[56] References Cited

U.S. PATENT DOCUMENTS

| | | | |
|---|---|---|---|
| 1,548,025 | 8/1925 | De Luca | 36/77 R |
| 3,206,874 | 9/1965 | Ellis et al. | 36/77 R |
| 3,925,914 | 12/1975 | Marcoux | 36/11.5 |
| 4,051,612 | 10/1977 | Damron | 36/72 R |
| 4,177,583 | 12/1979 | Chapman | 36/77 R |
| 4,257,177 | 3/1981 | Unsted | 36/77 R |
| 5,401,821 | 5/1995 | Hilgendorf | 36/100 |

FOREIGN PATENT DOCUMENTS

| | | | |
|---|---|---|---|
| 2126872A | 4/1984 | United Kingdom | 36/77 R |

*Primary Examiner*—Paul T. Sewell
*Assistant Examiner*—Jila Mohandesi
*Attorney, Agent, or Firm*—Birch, Stewart, Kolasch & Birch, LLP

[57] ABSTRACT

A safety shoe with detachable steel toe box, particularly a toe box made of steel plate, is fixed to invest surface of an original toe box in a shoe with a drawstring for protecting the latter and a worker's toes against impairment in working.

4 Claims, 8 Drawing Sheets

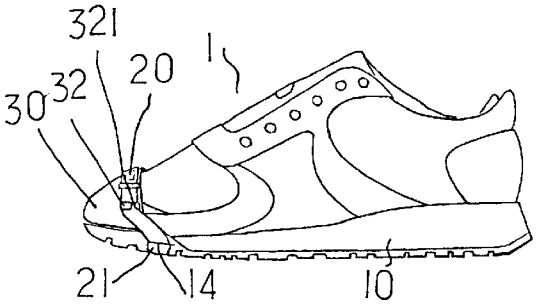
FIG. 5
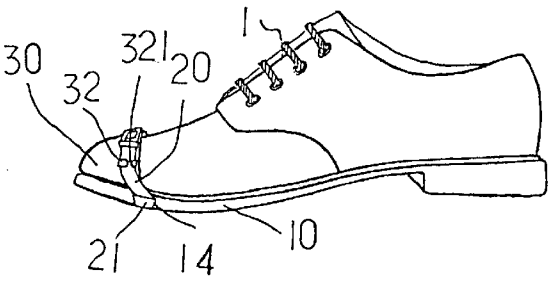
FIG. 6
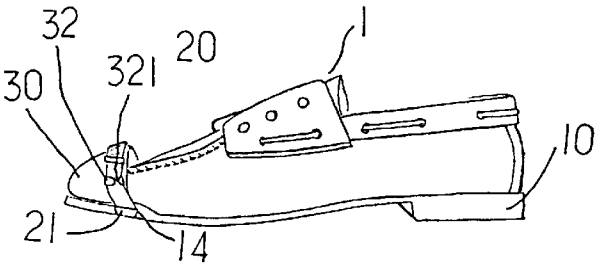
FIG. 7
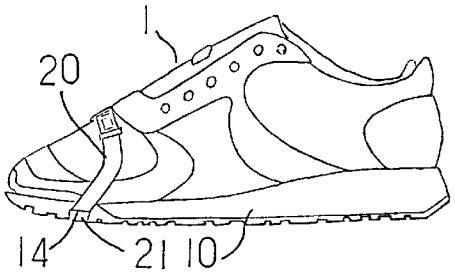
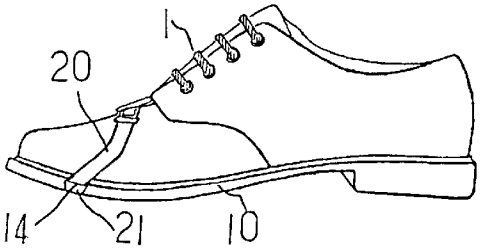
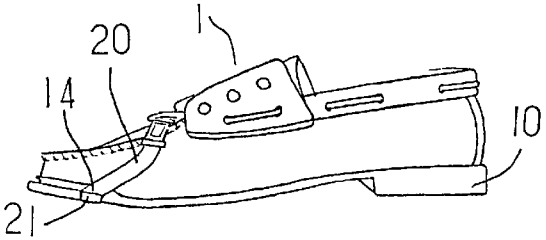

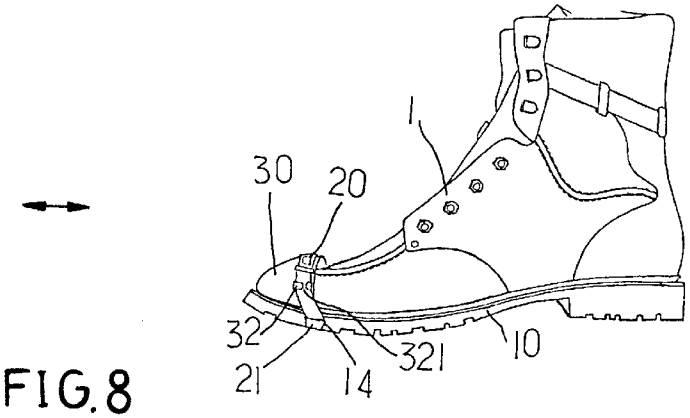
FIG.8
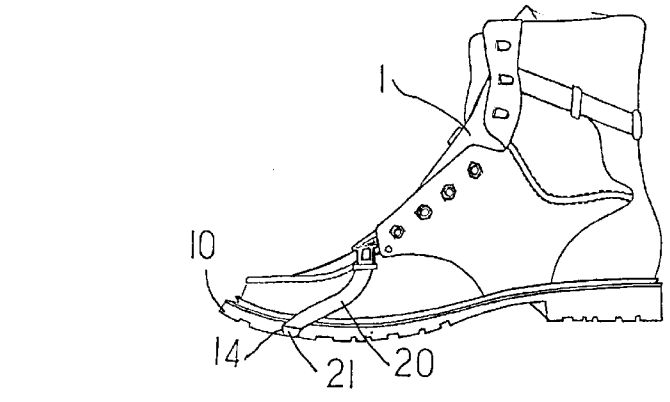
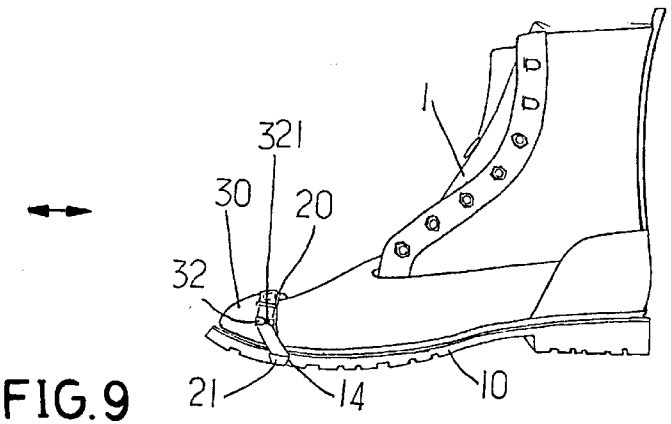
FIG.9
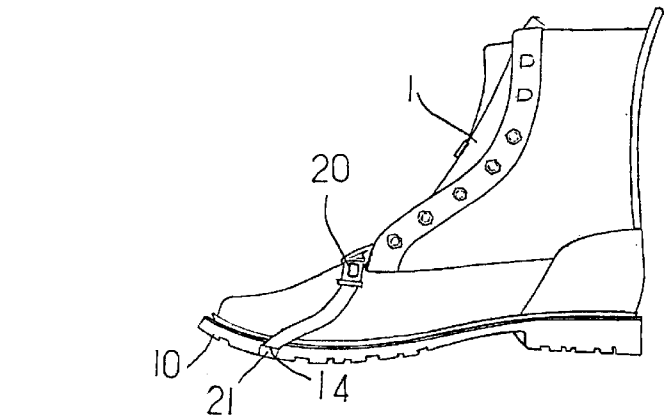

SAFETY SHOE WITH DETACHABLE STEEL TOE BOX

BACKGROUND OF THE INVENTION

This invention relates to a safety shoe with detachable steel toe box, particularly to a safety shoe, wherein a steel toe box is bound and fixed with a drawstring on outer edge of a leather toe box for protecting toes during working.

A conventional safety shoe is usually provided with a steel toe box invested by a leather toe box in a shoe body, wherein some defects are found as the following:

1. The steel toe box invested in the leather toe box is unreplaceable that results in squandering.
2. Changing shoes repeatedly when a worker goes on duty and off duty causes inconvenience.
3. If a worker wears a pair of safety shoes all day long without changing back for his usual shoes owing to one reason or another, his toes will surely get hurt in the long run.

In view of the above-described imperfections, after years of constant effort in research, the inventor of this invention has consequently developed and proposed this improved safety shoe with detachable steel toe box for protecting the toes against being hurt in working.

SUMMARY OF THE INVENTION

The structure of this invention is advantageous in following respects:

1. The steel toe box of this invention disposed on outer face of a leather toe box can effectively protect the leather toe box and toes inside when working at a special site.
2. As the drawstring and the steel toe box both are detachable, it requires no more extra pairs of shoes that would occupy storing space and take time for changing. A wearer can decide to mount or dismount the steel toe box at will.
3. When a pair of shoes is about to get worn-out, the steel toe box may be transferred to another pair of shoes for continuous use.
4. An inclined opening is formed to each of two lateral fixed wings of the steel toe box that facilitate mounting or dismounting the drawstring and the steel toe box without worrying the drawstring to slip off.
5. A cloth strip surrounded thick and hard paper board in the shoe body is glued at a front end in middle portion of the bottom layer to prevent the steel toe box from squeezing backwards when it is impacted.
6. A groove formed on a sole lateral face or along the cloth strip accommodates formation of a flange formed by an inwardly bent lower edge of the steel toe box to enhance combinative stability of the steel toe box and the shoe.
7. A fixing block is utilized for locking the drawstring by using screw-fixing elements that may be replaced with hexagonal conic screw-fixing elements for anti-slip purpose.

BRIEF DESCRIPTION OF THE DRAWINGS

For a better understanding to the present invention, together with further advantages or features thereof, at least one preferred embodiment will be elucidated below with reference to the annexed drawings in which:

FIG. 5 is an embodiment diagram 1 of this invention;

FIG. 6 is an embodiment diagram 2 of this invention;

FIG. 7 is an embodiment diagram 3 of this invention;

FIG. 8 is an embodiment diagram 4 of this invention;

FIG. 9 is an embodiment diagram 5 of this invention;

DETAILED DESCRIPTION OF THE PREFERRED EMBODIMENT

Figure 1:
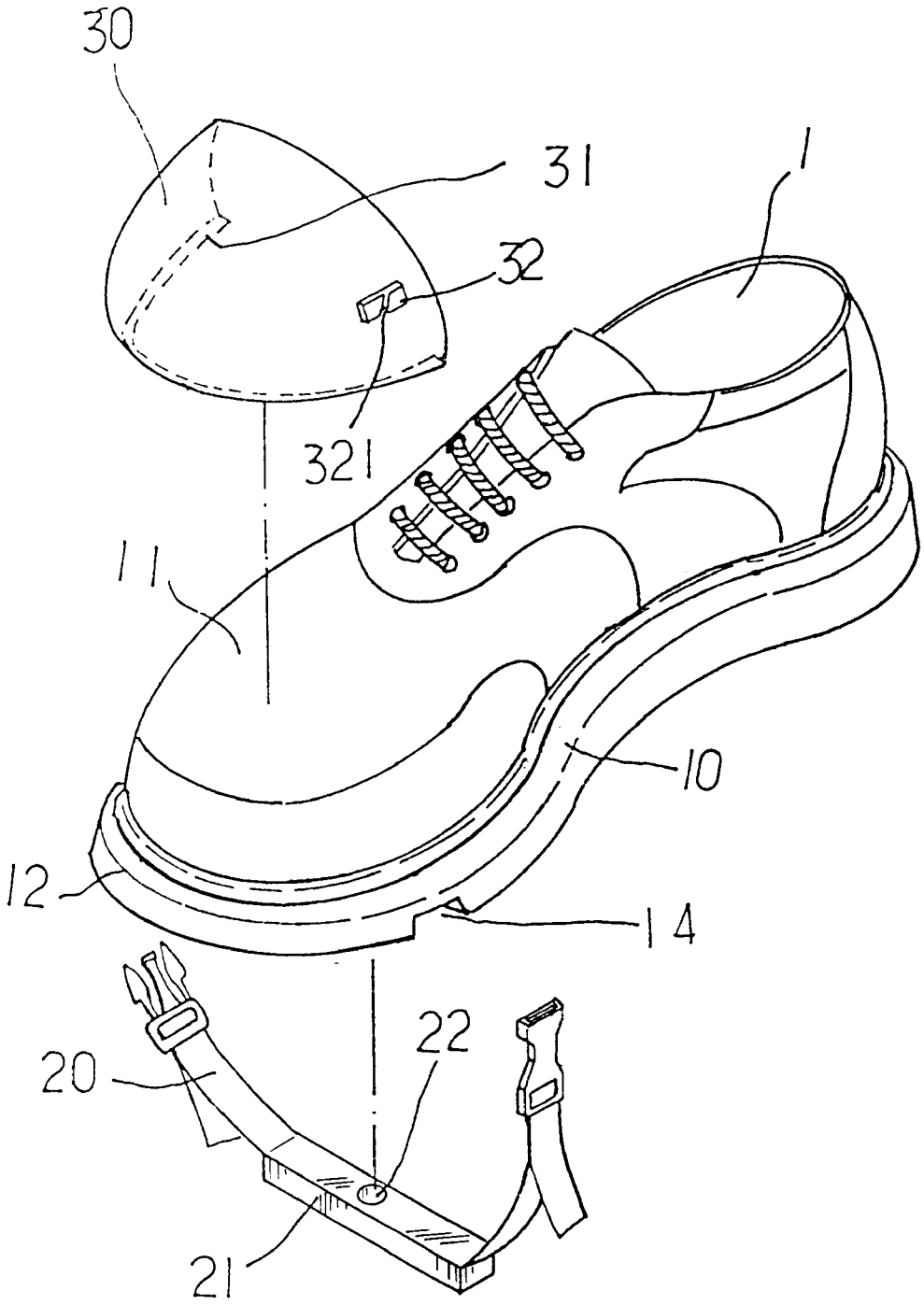
FIG. 1 is a three-dimensional exploded view of this invention.

As shown in FIG. 1 through FIG. 4, this invention mainly comprises a shoe 1, a drawstring 20, and a steel toe box 30. A front end in middle portion of a bottom layer in the sole 10 is glued with a thick and hard paper board 101 surrounded by a cloth strip, and a lateral face 11 of a sole 10 in the shoe 1 (or along a cloth strip 13, depending on way of fabrication) is provided with a groove 12, and a widened sole edge 121. A recess 14 is formed at a proper position of the front end in the sole 10, and a protruded column 15 is formed in the recess 14.

An inserting block 21 with a through hole 22 is connected at its both ends with the drawstring 20. The steel toe box 30 contains a lower edge bent inwardly to form a flange 31, a fixed wing 32 disposed at each of two lateral portions, wherein an inclined opening 321 is arranged.

Figure 2:
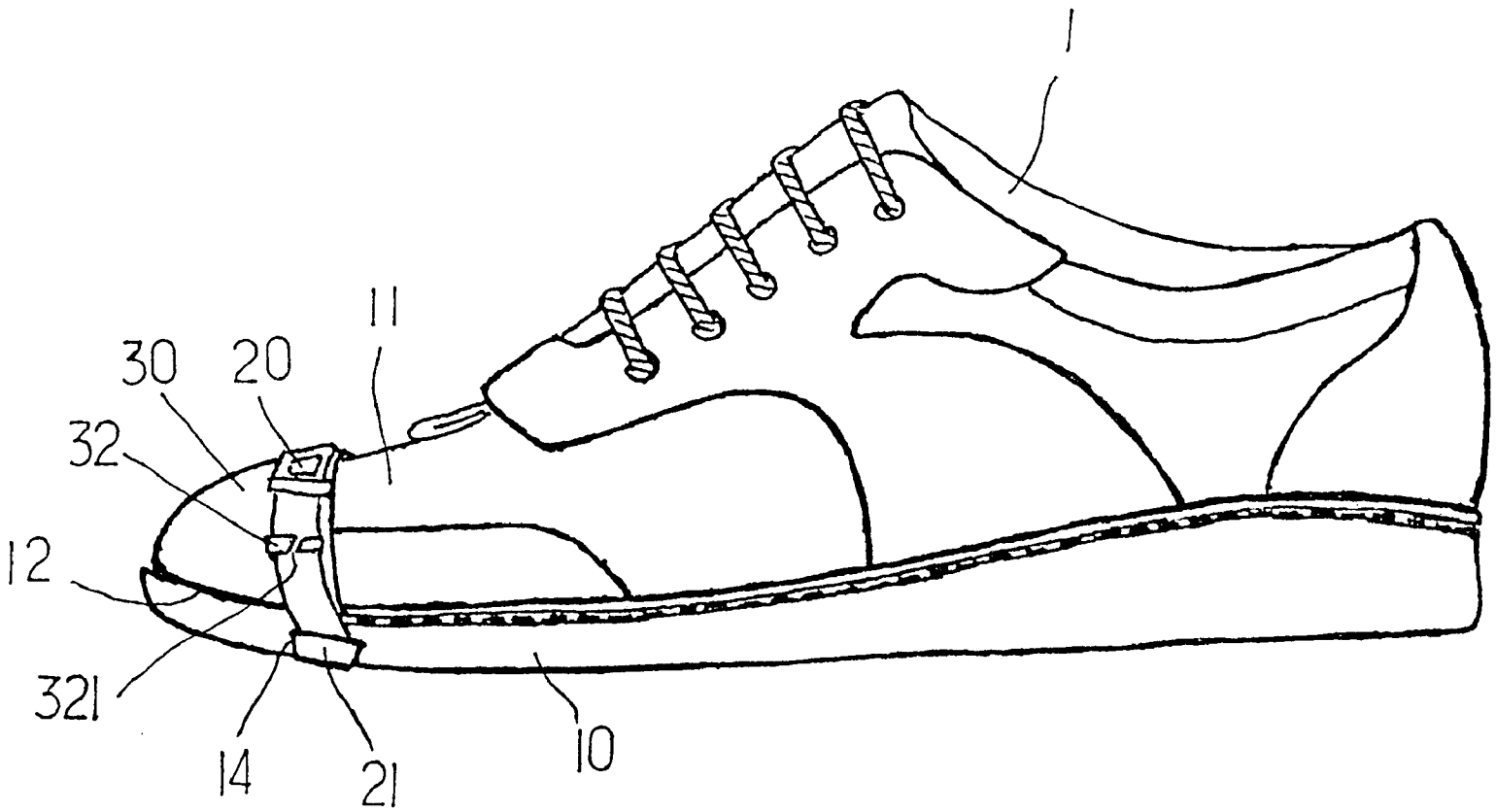
FIG. 2 is a three-dimensional view of this invention.
Figure 3:
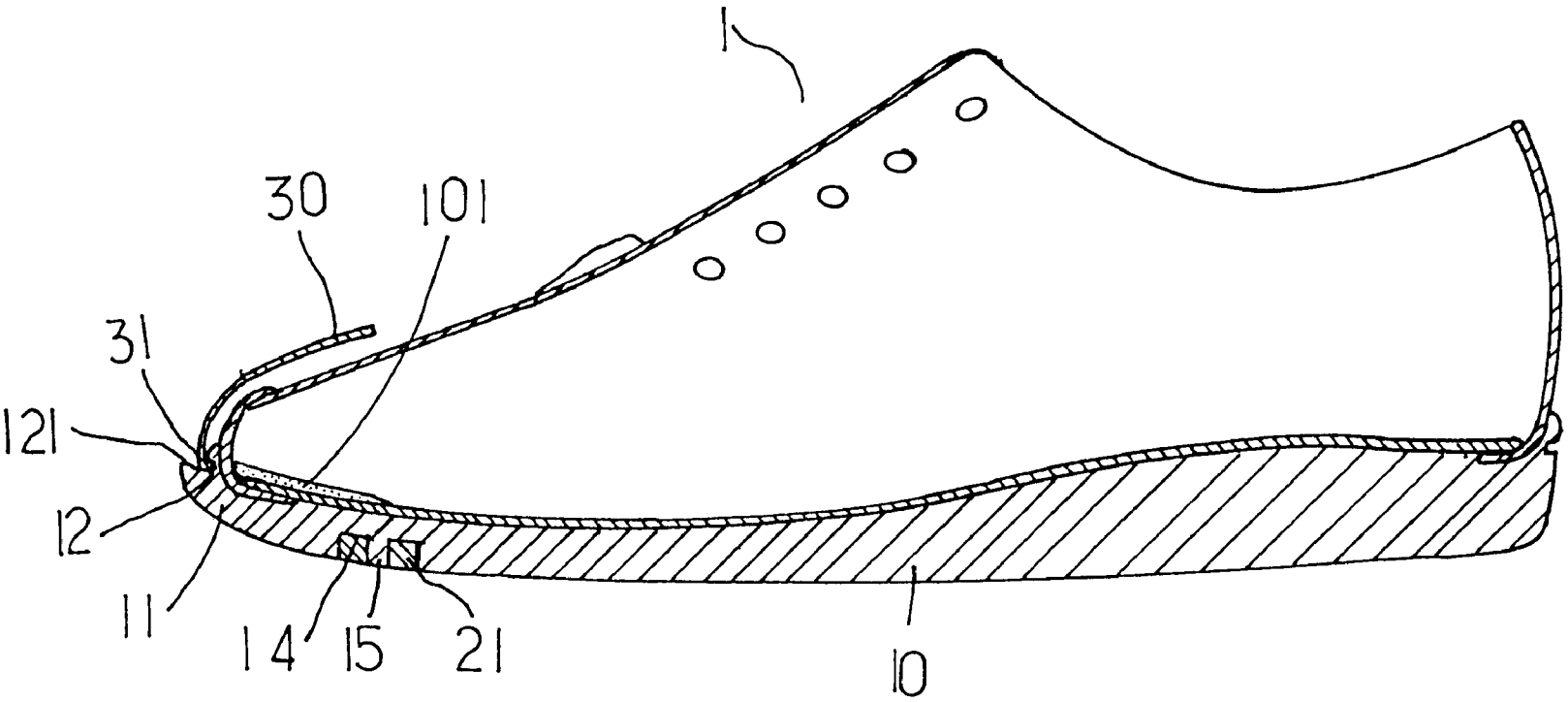
FIG. 3 is a cutaway sectional view showing combination of a groove in a sole lateral face and a steel toe box of this invention.
Figure 4:
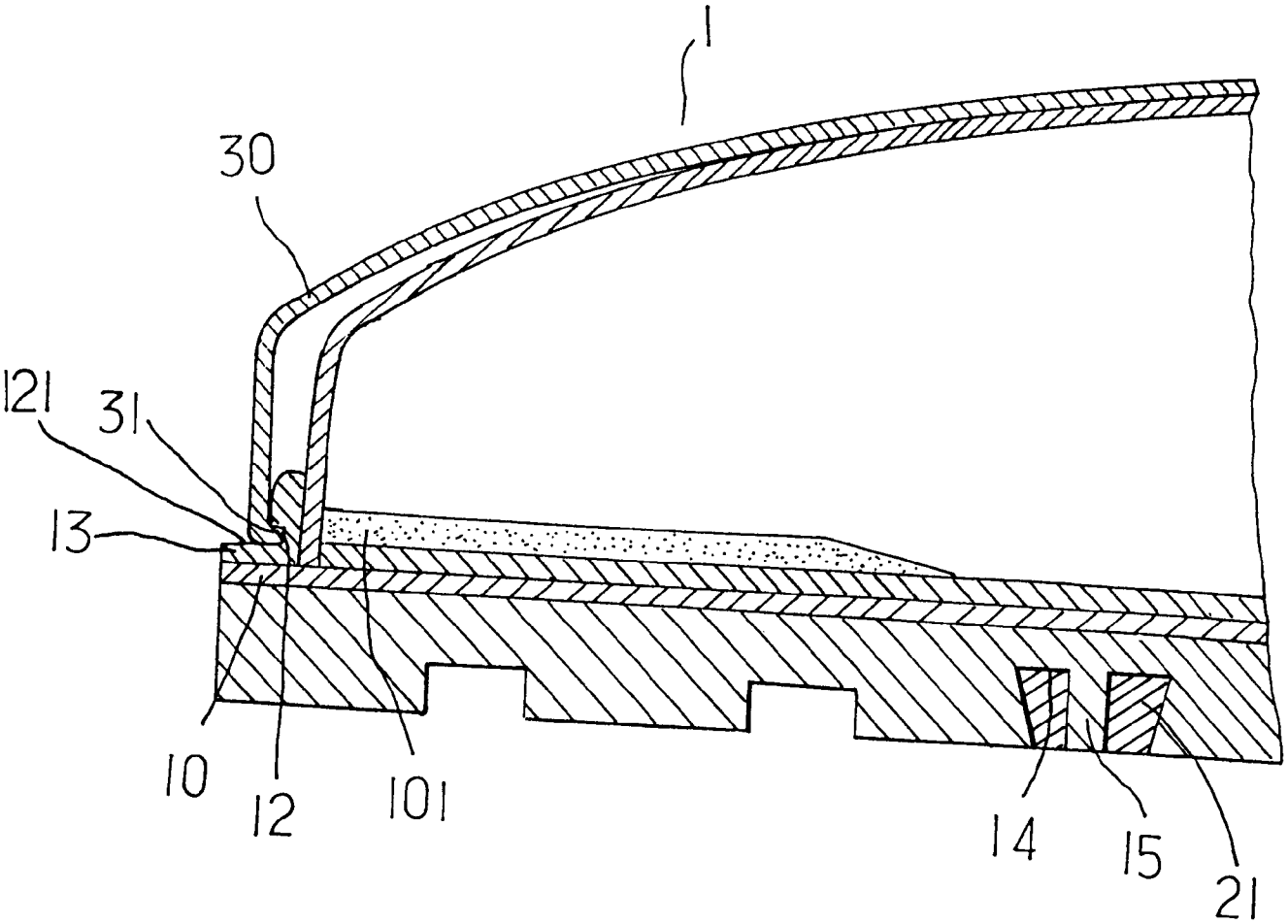
FIG. 4 is a cutaway sectional view showing combination of a groove disposed along a cloth strip and the steel toe box of this invention.

When assembling, the through hole 22 in the inserting block 21 is collared onto the protruded column 15 in the sole 10 to have the inserting block 21 inserted in the recess 14, and the flange 31 formed by the bent inwardly lower edge of the steel toe box 30 is fixed in the groove 12 of the lateral face 11 of the sole 10 (or along the cloth strip 13). Then, the drawstring 20 is collared and fastened to the fixed wing 32 having the inclined opening 321 to enable the steel toe box 30 to be fixed at the outer face of the original toe box for providing a detachable steel toe box 30. The drawstring 20 may be alternatively glued and fixed to the sole 10 as shown in FIG. 2.

Referring to FIG. 5 through FIG. 9, as the drawstring 20 and the steel toe box 30 are attached to the shoe 1 by way of combination, so that replacement is possible if desired. Therefore, a user will not necessarily prepare extra shoes for change or wear a safety shoe all the time.

Figure 10:
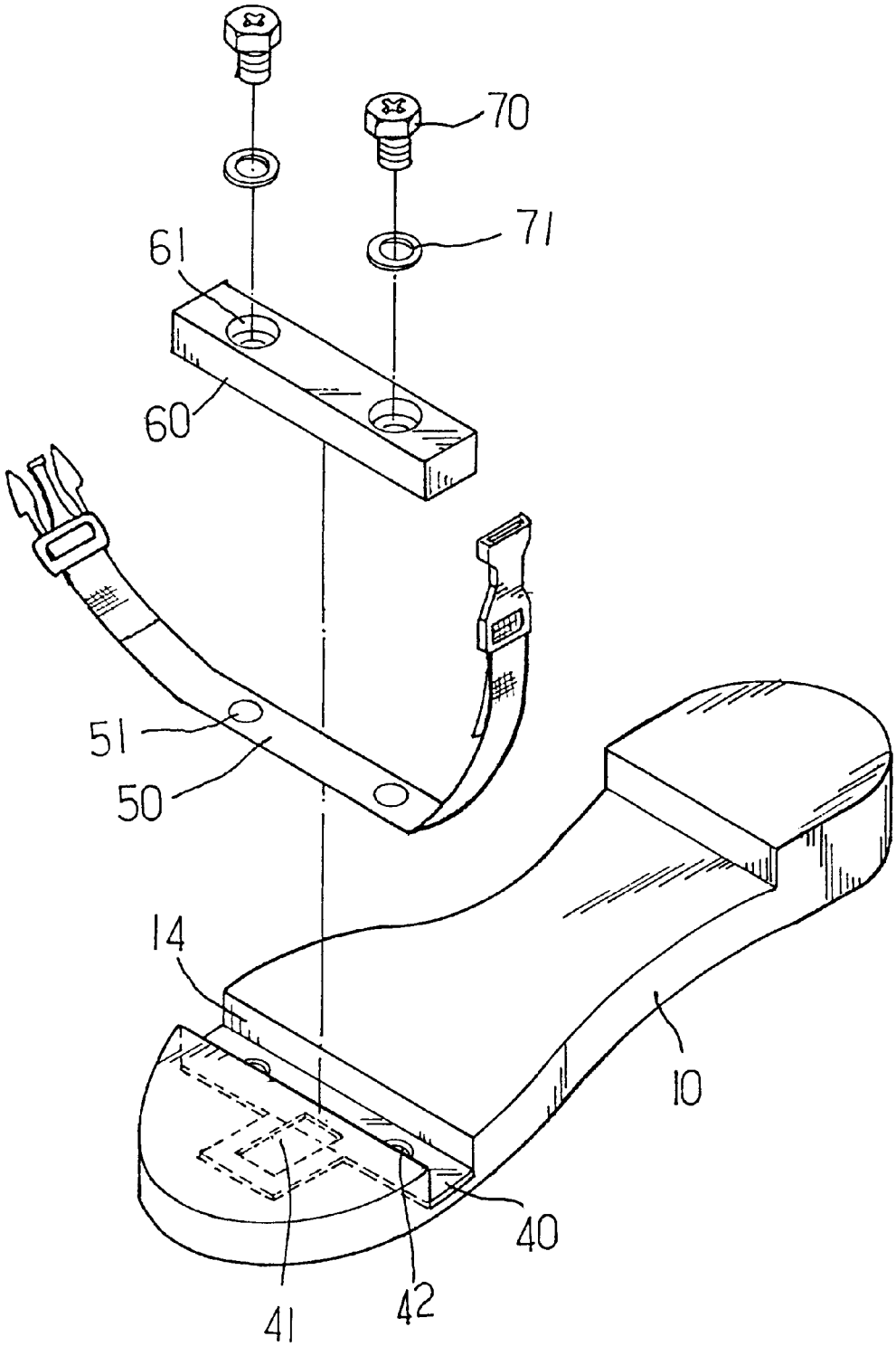
FIG. 10 is a three-dimensional exploded view of another embodiment of this invention.
Figure 11:
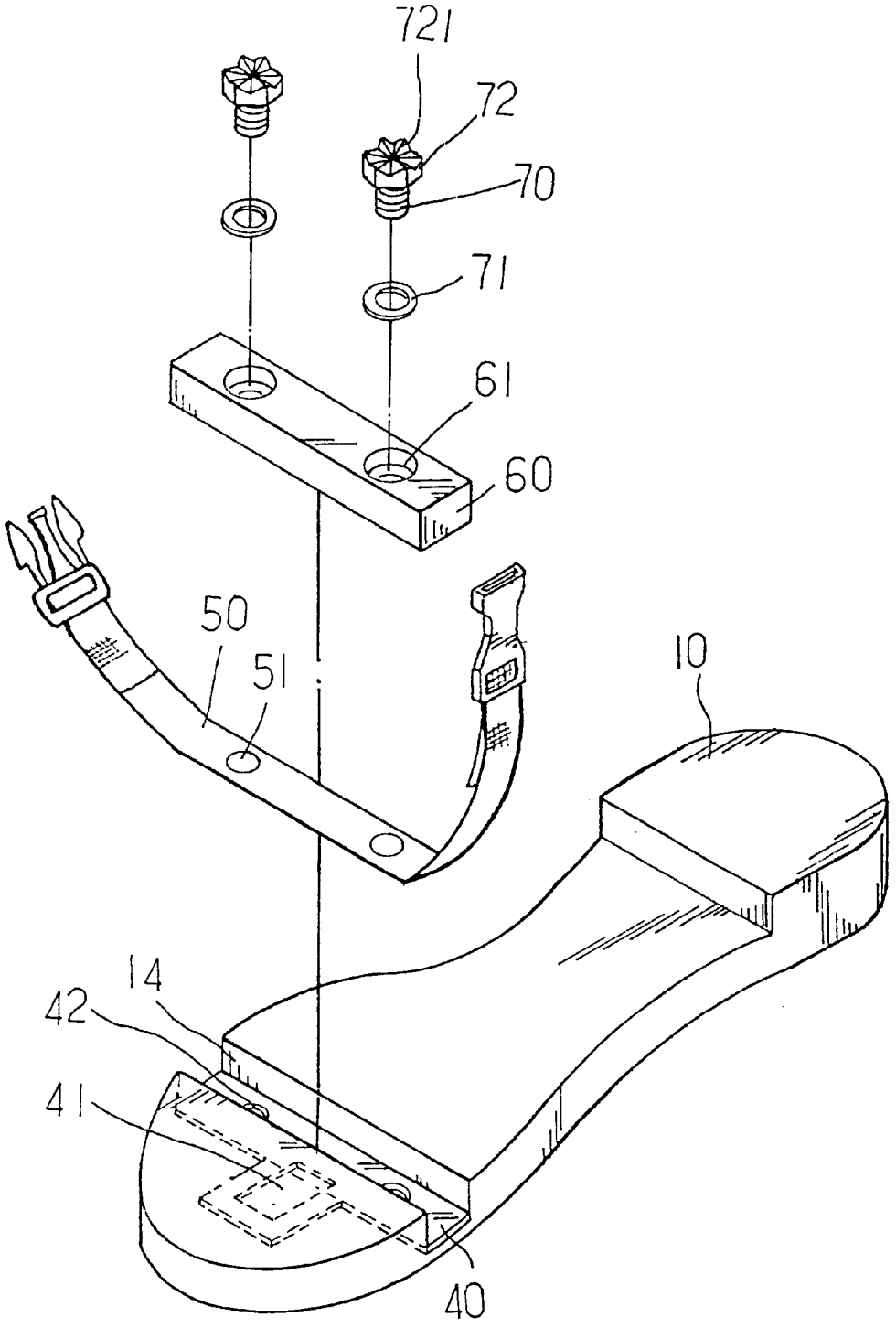
FIG. 11 is a three-dimensional exploded view of a further embodiment of FIG. 10.

FIG. 10 shows another embodiment of this invention. As it indicates, a T-shape steel plate 40 is inserted and glued in the recess 14 of the sole 10, wherein a square hole 41 is formed in middle portion of the steel plate 40 facilitating gluing to the sole 10; a tapped hole 42 is disposed at each side of the recess 14; a drawstring 50 is provided with through holes 51 corresponding to the tapped holes 42 in the steel plate 40; an inserting block 60 having stove holes 61 corresponding to the through holes 51 may be fitted in the recess 14 by penetrating a screw-fixing element 70 to pass through a washer 71 for fixing the drawstring 50. Moreover, the screw head 72 of the screw-fixing element 70 may be designed in hexagonal conic shape with protruded stripes 721 (as shown in FIG. 11) for anti-slip purpose.

What is claimed is:

1. A safety shoe with detachable steel toe box, comprising:

a shoe, wherein a front end at a middle portion of the bottom layer in said shoe is glued with a thick and hard paper board surrounded by a cloth strip; and a lateral face of said sole in said shoe (or along a cloth strip,) is provided with a groove, and a widened sole a recess is formed at a proper position of the front end in said sole, and a protruded column is formed in said recess;

an inserting block with a through hole being connected at its both ends with a drawstring; and a steel toe box contains a lower edge bent inwardly to form a flange, a fixed wing disposed at each of two lateral portions, wherein an inclined opening is arranged;

when assembling, said through hole in said inserting block being collared onto said protruded column in said sole to have said inserting block inserted in said recess, and said flange formed by the bent inwardly lower edge of said steel toe box being fixed in said groove of said lateral face of said sole (or along said cloth strip,) then, said drawstring being collared and fastened to said fixed wing having said inclined opening to enable said steel toe box to be fixed at the outer face of the original toe box for providing a detachable steel toe box.

2. The safety shoe with detachable steel toe box according to claim 1, wherein said drawstring may be alternatively glued to said sole.

3. The safety shoe with detachable steel toe box according to claim 1, wherein a T-shape steel plate is inserted and glued in said recess of said sole; a square hole is formed in middle portion of said steel plate facilitating gluing to said sole; a tapped hole is disposed at each side of said recess; a drawstring is provided with two through holes corresponding to said tapped holes in said steel plate; an inserting block having stove holes corresponding to those said through holes may be fitted in said recess by penetrating a screw-fixing element to pass through a washer for fixing said drawstring in said recess.

4. The safety shoe with detachable steel toe box according to claim 3, wherein a screw head of said screw-fixing element may be designed in hexagonal conic shape with protruded stripes.

* * * * *